US011608644B2

(12) United States Patent
Bilge

(10) Patent No.: US 11,608,644 B2
(45) Date of Patent: Mar. 21, 2023

(54) UNIVERSAL Z-Z CHANNEL FOR MOUNTING WALL PANELS TO EXISTING WALL

(71) Applicant: Henry H Bilge, Fort Lee, NJ (US)

(72) Inventor: Henry H Bilge, Fort Lee, NJ (US)

( * ) Notice: Subject to any disclaimer, the term of this patent is extended or adjusted under 35 U.S.C. 154(b) by 0 days.

(21) Appl. No.: 17/091,255

(22) Filed: Nov. 6, 2020

(65) Prior Publication Data

US 2022/0145641 A1 May 12, 2022

(51) Int. Cl.
*E04F 13/08* (2006.01)
*E04B 1/76* (2006.01)

(52) U.S. Cl.
CPC ..... *E04F 13/0803* (2013.01); *E04B 1/7629* (2013.01); *E04F 13/0875* (2013.01)

(58) Field of Classification Search
CPC ..... E04F 13/0803; E04F 13/0875; E04B 1/7629
See application file for complete search history.

(56) References Cited

U.S. PATENT DOCUMENTS 9,151,052 B2 * 10/2015 Krause ..... E04F 13/0828
9,200,455 B2 * 12/2015 Preston ..... E04F 13/0803

* cited by examiner

*Primary Examiner* — Patrick J Maestri
(74) *Attorney, Agent, or Firm* — Kaplan Law Practice LLC

(57) ABSTRACT

Disclosed is a system of cladding along an existing exterior wall of a building featuring a plurality of Z-shaped components deployed in a parallel spaced apart arrangement, with an insulation panel in between two of the Z-shaped components. The Z-shaped components having a J-wall to enforce a moisture gap between exterior wall paneling and insulation. The Z-shaped components may feature Edge-components when the line of insulation panels needs to be interrupted or when it reaches a corner or edge of a wall.

18 Claims, 21 Drawing Sheets

UNIVERSAL Z-Z CHANNEL FOR MOUNTING WALL PANELS TO EXISTING WALL

BACKGROUND OF THE INVENTION

The present invention relates generally to a wall system, and more particularly, to a system for easily mounting wall panels over an existing wall while concealing exterior insulation.

Exterior decorative works of an existing wall are exposed to elements, in particular, to moisture. Although caulking and other gap remediation techniques abound and are well known, moisture may still penetrate. Despite moisture penetration, good airflow will wick away water before mold and other destructive consequences set in. For this reason, sound construction practices, and in some instances, building code, require that exterior panels are separated from insulation by a gap of approximately 2.5 centimeters.

This gap is also highly desirable to promote conservation of energy inside building structures. Due to the principal of conduction, even insulation will transfer hot or cold onto a surface it is insulating and thus eventually loose some of its effectiveness. To overcome the loss of insulating efficiency caused by conduction, sound construction practices recommend creating an air gap between an exterior layer of exterior insulation and the layer of exterior wall paneling. This air gap creates a reflective barrier, where the hot or cold air radiating from the exterior wall panel is reflected by the insulation layer due to the presence of the air gap.

Enforcement of the air gap between the insulation layer and the exterior wall paneling is a known practice that is often dictated by the building code. However, there is presently no standard and failsafe compliance method. Instead, contractors attempt to comply by inserting a separate strip of material between the exterior paneling and the insulation. Existing methods have several serious shortcomings. The first one is higher cost and length of installation. The cost is increased due to the requirement of purchasing, stocking and components required in ensuring that a gap is present. Secondly, installation requires a separate step involving a non-standard component. Third, it is often difficult to keep the thickness of the air gap uniform when utilizing non-standard and disparate components. Finally, the presence of an additional structural component adds to the complexity of a project and increases the risk of mistake or accident occurring due to the additional level of complexity It is therefore desirable to provide a system that creates a single structural component which form a frame for attaching exterior insulation to an existing wall, which also serves as a point of attachment of exterior paneling, and which enforces a uniform air gap between the exterior paneling and the layer of insulation.

SUMMARY OF THE INVENTION

It is an object of the present invention to provide for a simple and uniform means of ensuring that an air gap exists between an exterior or cladding covering and a layer of exterior insulation.

It is another object of the present invention to provide a sustainable and adequate airflow between cladding panels and insulation, which among other benefits, prevents unchecked moisture buildup.

It is still another object of the present invention to provide a first moisture gap that is enforceable by the shape of the Z-girt or Z-shaped component holding the insulation panels and exterior wall panels It is still another objection of the present invention to provide a wide first moisture gap above the insulation panels and below the cladding panels, and a second moisture gap between the insulation panels and an existing wall of the structure.

Therefore, in accordance with the present invention, a system for ensuring that exterior insulation is installed at a desired distance from shell or cladding panels, includes a plurality of Z-shaped components. The plurality of Z-shaped components attaching in a parallel and spaced apart association with each other along an existing wall. Each Z-shaped component is made of a first wall, a second wall and a J-shaped third wall. The first wall having a first end and a second end is. The first wall being preferably parallel to an existing wall and is mounted either vertically, horizontally, or diagonally thereon.

The second wall extends forwardly at an angle, preferably a right angle, from the first wall. The free end of the second wall contains the J-shaped wall. The J-shaped wall is made of two portions. The first portions is parallel to the first wall but extends in the opposite direction from the first wall. The second portion extends rearwardly from the free end of the first portion, with a free end of the second portion being located at a distance above the first wall. The first portion of the J-shaped wall is configured to accept an exterior or cladding paneling bolted thereto.

The J-shaped wall extends for the entire length of the Z-shaped component and forms a hollow channel that is open on one side, namely between the free end of the second portion and the second wall. In an alternative embodiment an insert is configured to serve as a strength element and to receive the mounting bolts. The strength element is inserted into the hollow channel formed by the J-shaped portion. Additional durability cladding may in the form of a protective bracket placed on the surface of the first wall and which may include a front lip to further shield the first wall. The protective bracket configured to receiving the fastening bolt.

In another embodiment, the second wall of the Z-shaped component also comprises an upper lip. The protruding upper lip extending obliquely and at an angle, preferably a right angle, to the first side of the second wall. The upper lip is set off from the free end of the first side and is co-planar to the free end of the second portion. In an embodiment in which the second wall is not oriented perpendicularly to the first wall, the upper lip will preferably be disposed parallel to the first wall, which would translate to an acute or obtuse angle with respect to the second wall.

In another embodiment the second wall of the Z-shaped component contains a flared section along its height. The concave section may exist throughout the length of the second wall and appear on both or one of the first and second sides of the second wall. The flared section is intended to burrow in the first end of an insulation panel adjacent to the second side and the second end of the next insulation panel that is adjacent to the first side, to induce a greater moisture seal between the adjacent components. The next insulation panel's first end will similarly be encased against a flared protrusion of the second side of the next Z-shaped component.

An edge component is disclosed. The edge component being in a spaced apart parallel relation to at least one Z-shaped component in the plurality of Z-shaped components deployed in parallel to each other along an existing wall. The edge component terminating a section of insulating panels. An edge component is comprised of a first wall, a second wall extending forwardly at an angle, preferably a right angle, from the first wall, and an J-shaped wall on the free end of the second wall extending in the same direction as the first wall in a parallel and spaced apart configuration with the first wall. The J-shaped wall of the edge component formed from first portion and second portion. The first portion being parallel to the first wall and configured to accept an external or cladding panel bolted to the exterior surface of the first portion. The second portion extending rearwardly from the free end of the first portion and having a free end that terminates at a distance above the first wall. The free end of the second portion on the edge component being co-planar with the free end of the second portion of a contiguous Z-shaped component. Meaning that the free ends of the second portion being at the same distance relative to the first wall of their respective first walls. The free end of either the Z-shaped component or the edge component forming and enforcing the desired air gap between the exterior surface of an insulation panel and the bottom surface of an exterior panel.

The J-shaped wall of the edge component forms a hollow channel that is open on one side, namely the side between the free end of the second component and the second wall. An insert forming a strength element is disclosed for the hollow channel of the edge component. This insert being interchangeable with the insert for any of the other Z-shaped components. The insert may be placed into the hollow channel by inserting it into the opening on the either side of the hollow channel or by wedging the insert into the open side of the hollow channel.

DESCRIPTION OF THE PREFERRED EMBODIMENTS

Figure 1:
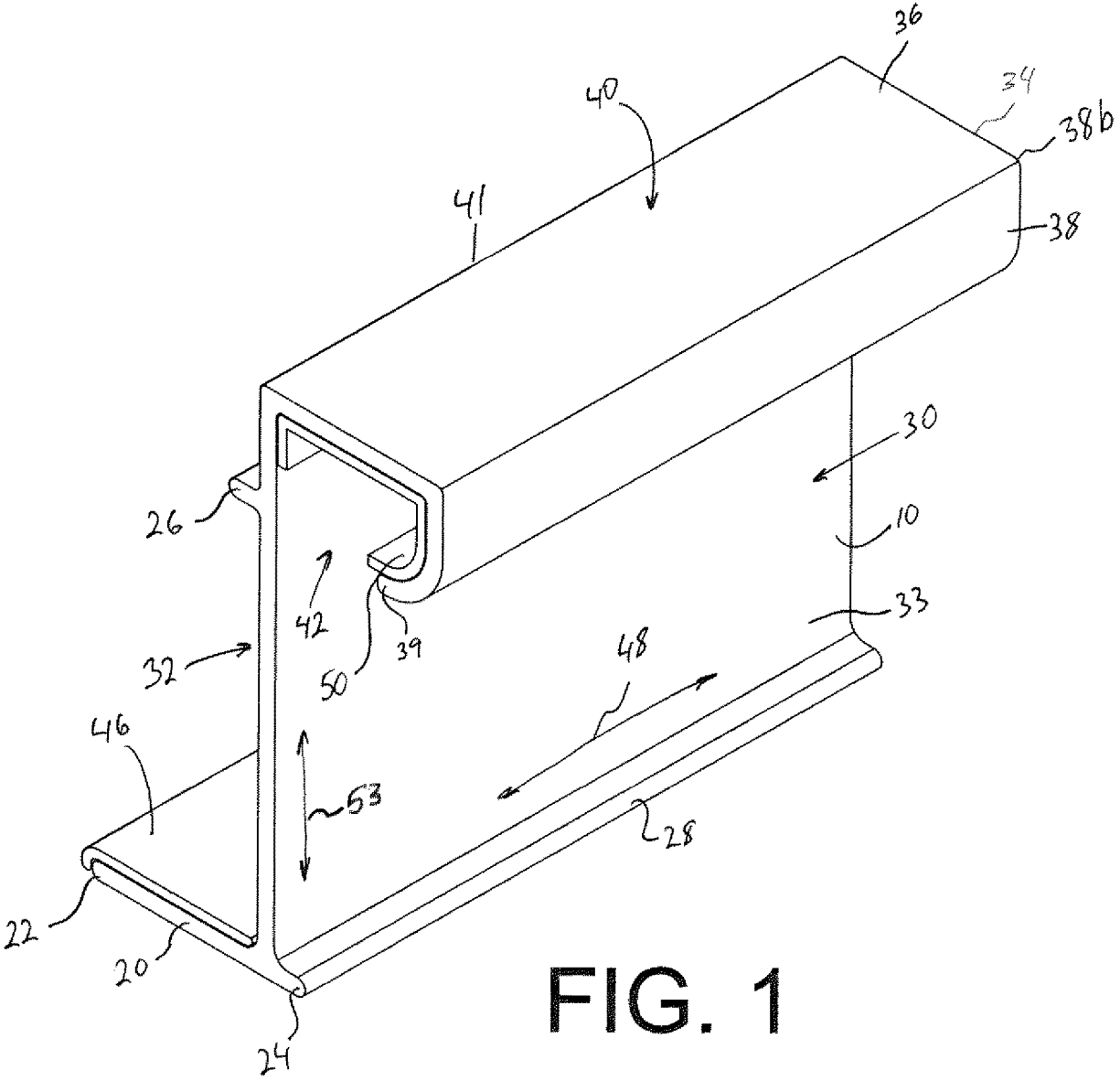
FIG. 1 is a perspective view of the preferred embodiment of the Z-shaped component.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Turning now descriptively to the drawings, shown in FIG. 1 is one embodiment of the Z-shaped component 10, having a first wall 20, the second wall 30 and the J-shaped wall 34. The first wall 20, having the first end 22 and the second end 24. The second wall 30 extends forwardly, at an angle, preferably a right angle, from the second end 24, or slightly offset from the second end 24, of the first wall 20. In the embodiment shown in FIG. 1, the second wall 20 is set off from the second end 24, and this set off creating a lower lip 28 that is coplanar with the rest of the first wall 20. The set off creating the lower lip 28 is preferably uniform for the entire length 48.

The free end 41 contains the J-shaped wall 34. The J-shaped wall 34 is further comprised of the first portion 36, which is substantially plane and in parallel orientation with the lower lip 28 of the first wall 20 but extends in the direction opposite to the first wall 20. The first portion 36 contains an outer surface 40, which as will be demonstrated in figures below, is configured to accept exterior wall panels 90. The second portion 38 extends rearwardly from the free end 38*b* of the first portion 36. Approximately halfway down along the height of the second portion 38, the second portion 38 bends towards the fir side 33, with the free end 39 terminating at a distance from the second side. The structure of the J-shaped wall 34 creates a hollow channel 42, which may admit an insert 55.

While only one Z-shaped component 10 is shown in FIG. 1, preferably a plurality of Z-shaped components 10 are fastened to the exterior surface of an existing wall, in a parallel spaced apart orientation to each other, with an insulation panel 72 (FIG. 5) fitting between each two parallel Z-shaped components. The length 48 of the Z-shaped component 10 is variable and commensurate to the wall of the building or with a deployment plan of insulating panels or exterior panel. The height 53 of each Z-shaped component 10, and in particular, the second wall 30, in the plurality of such Z-shaped components, may be uniform or variable from one component to the next to support an uneven surface design of exterior wall panels, or wall panels of varied thickness.

Figure 2:
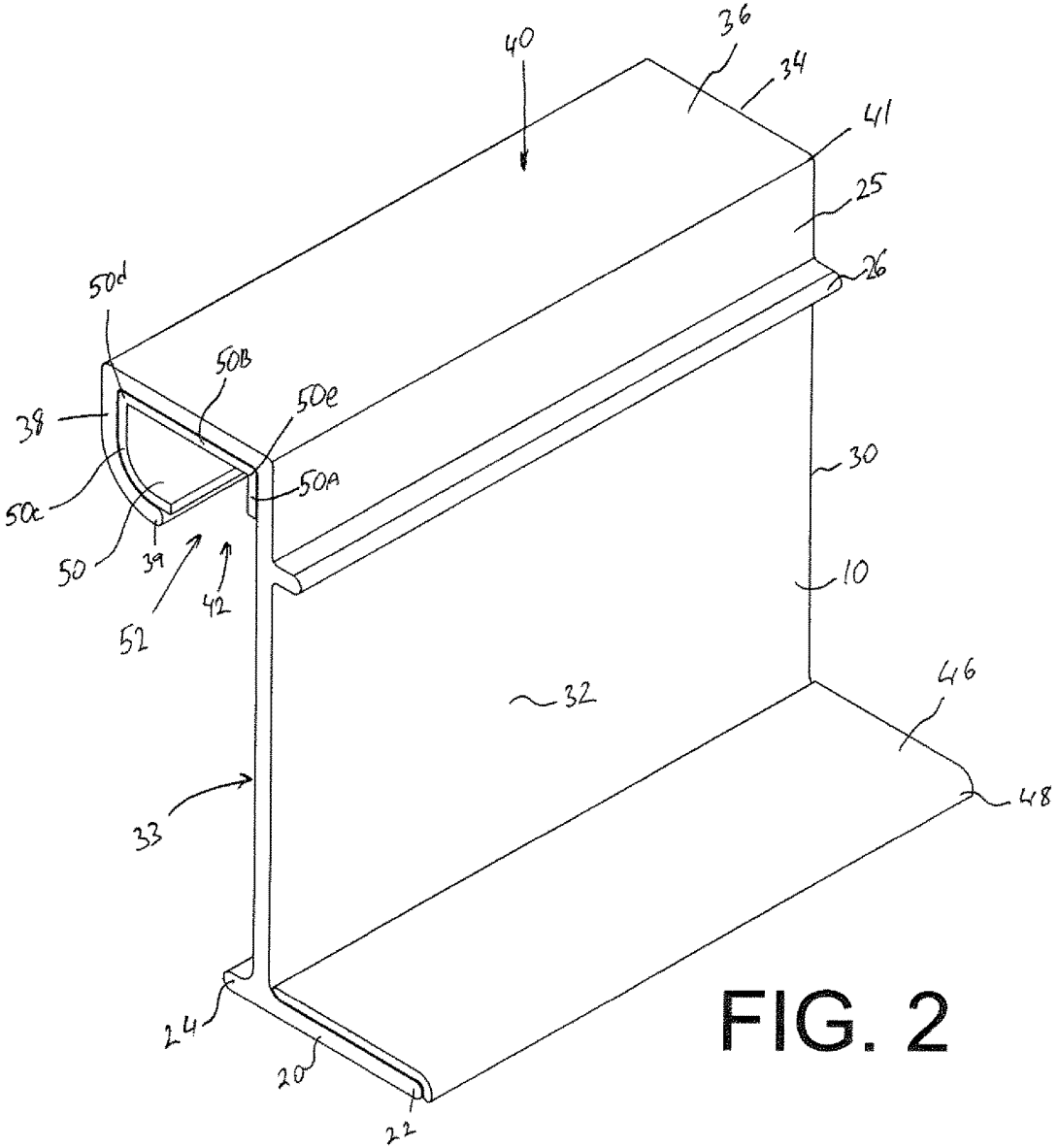
FIG. 2 is a perspective view of the preferred embodiment shown in FIG. 1.

FIG. 2 demonstrates a perspective top view of the Z-shaped component 10. Shown in figure is the first wall 20, the second wall 30, the J-shaped wall 34. The upper lip 26 juts out laterally from the first side 32, at an angle, preferably a right angle, to the second wall 30. The lip 24 is set off from free end 41 creating a gap 25. The height of the gap 25 may be equal to or different from the depth of the hollow channel 42.

A protective bracket 46 may be used to cover the surface of the first wall 20. The protective bracket 46 may additionally contain a flange 48 extending rearwardly. The flange 48 being adjacent to the first end 22. The protective bracket 46 accepts a fastener pierced therethrough and offers a stronger anchor location than the first wall 20. The first wall 20, as well as the overall Z-shaped component, are made from a polymeric composition which may be fibrous for strength.

Visible in FIG. 2 is the removable insert 50. The removable insert 50 is comprised of a first wall 50*a*. The first wall 50*a* is adjacent to the second wall 30. Extending laterally from the first wall 50*a* is a second wall 50*b*. The second wall 50*b* being adjacent to the first portion 36 of the J-shaped wall 34. Extending rearwardly from the second wall 50*b* is the third wall 50*c*. The third wall 50*c* being adjacent to the second portion 38 and having a shape conforming to the shape of the second portion 38. The corner 50*e* between the first and second walls 50*a* and 50*b* is adjacent to the angle formed by the second wall 30 and the J-shaped wall 34. The corner 50*d* is adjacent to the corner formed by the first portion 36 and second portion 38. The insert 50 may be introduced into the hollow channel 42 through the side openings 52 or through the gap between the free end 39 and the second side 33.

It should be appreciated that the insert 50 need not be shaped in the fashion demonstrated in FIG. 2 but can be shaped as a solid rod or cuboid. The insert 50 is intended additional strength to J-shaped wall 34 and serve as an anchor point for a fastener that carries the exterior wall paneling. The insert 50 need not be the same length as the hollow channel 42.

Figure 3:
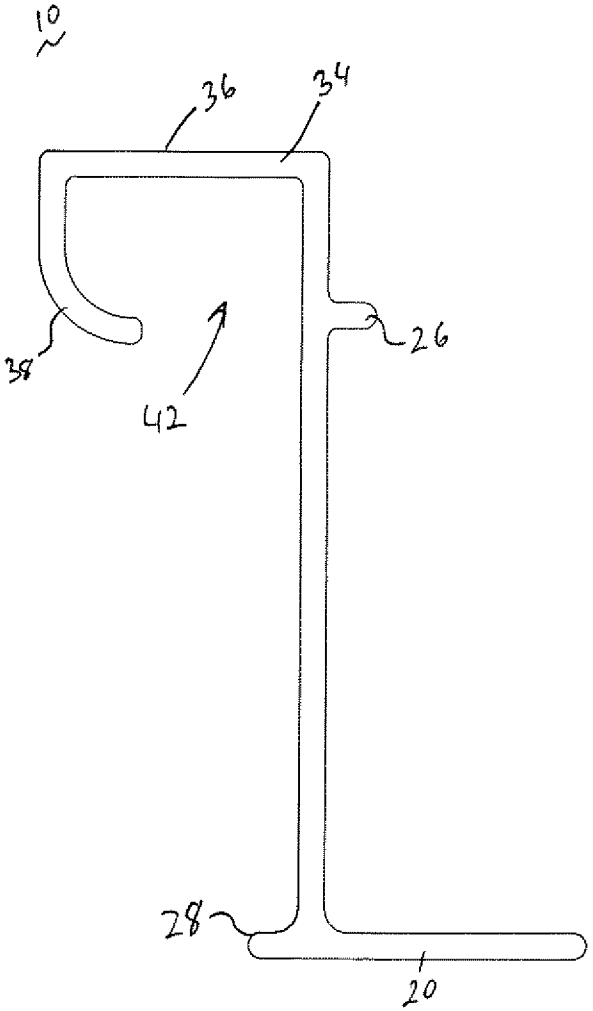
FIG. 3 is a side elevational view of a Z-shaped component.
Figure 3A:
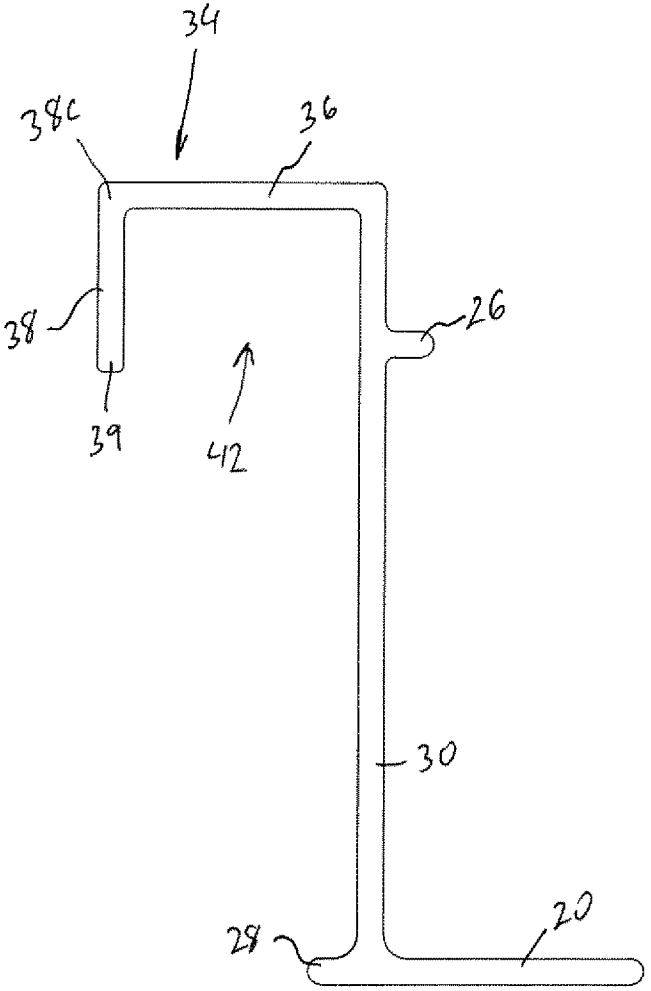
FIG. 3A-3H demonstrating various different shapes of the second portion of the J-shaped wall of either the Z-shaped component or the Edge component.
Figure 3B:
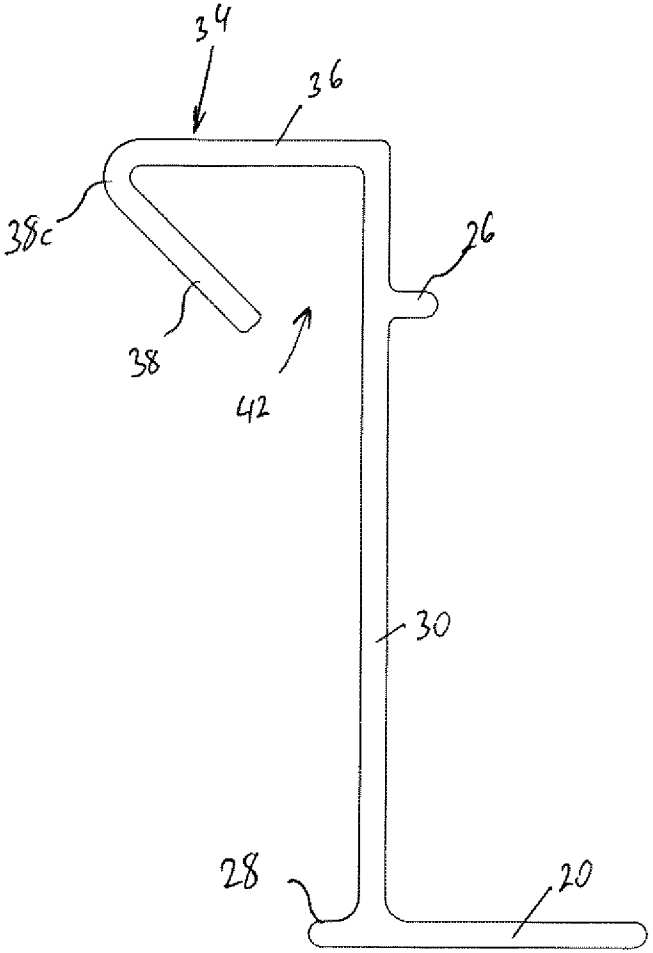
Figure 3C:
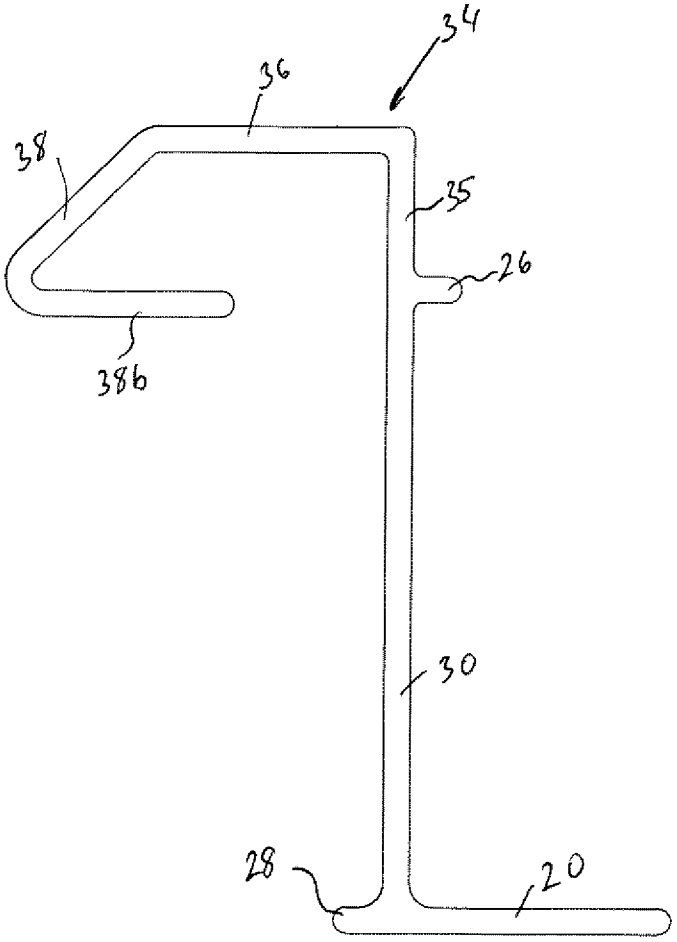
Figure 3D:
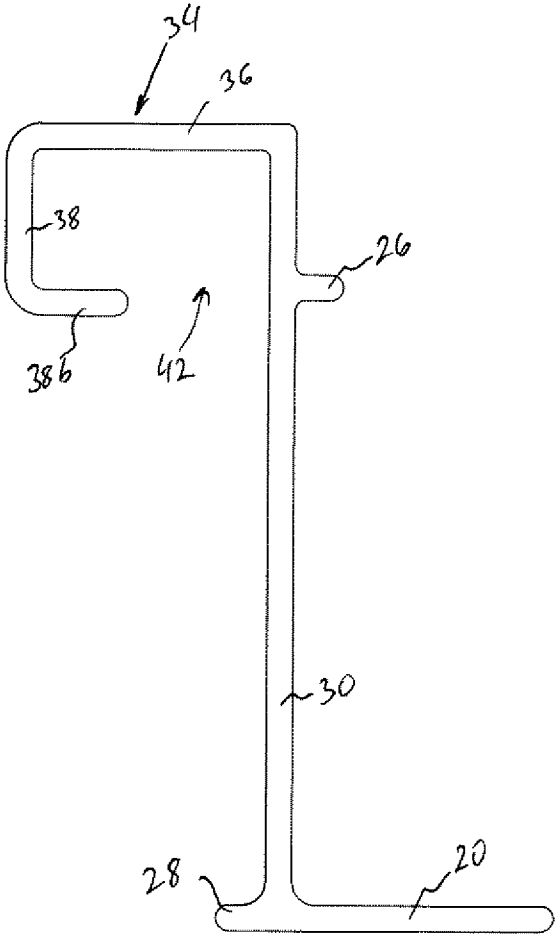
Figure 3E:
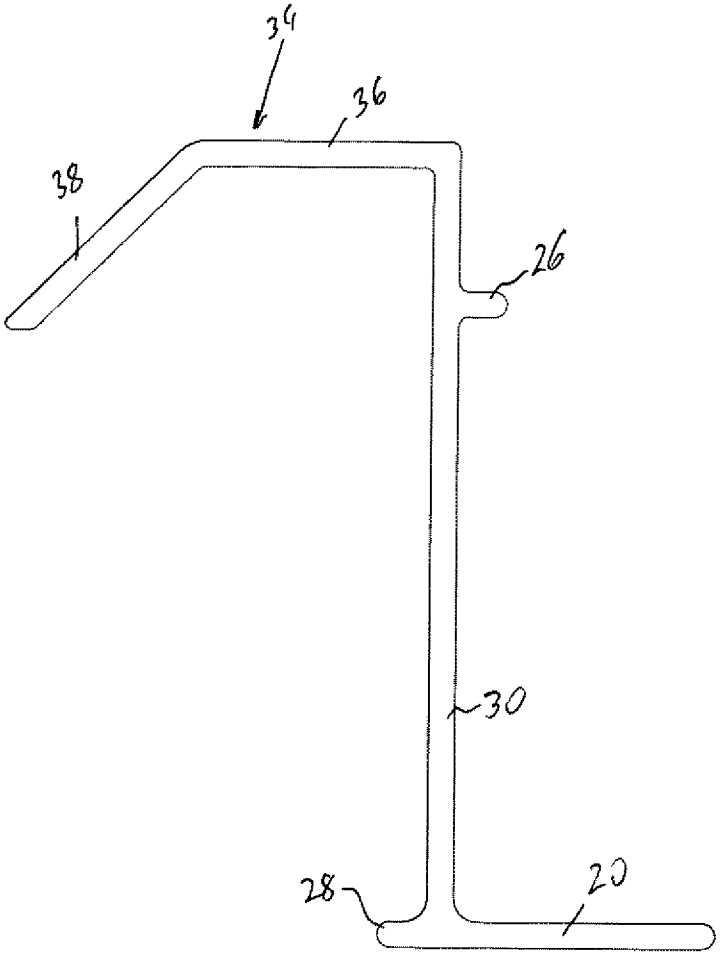
Figure 3F:
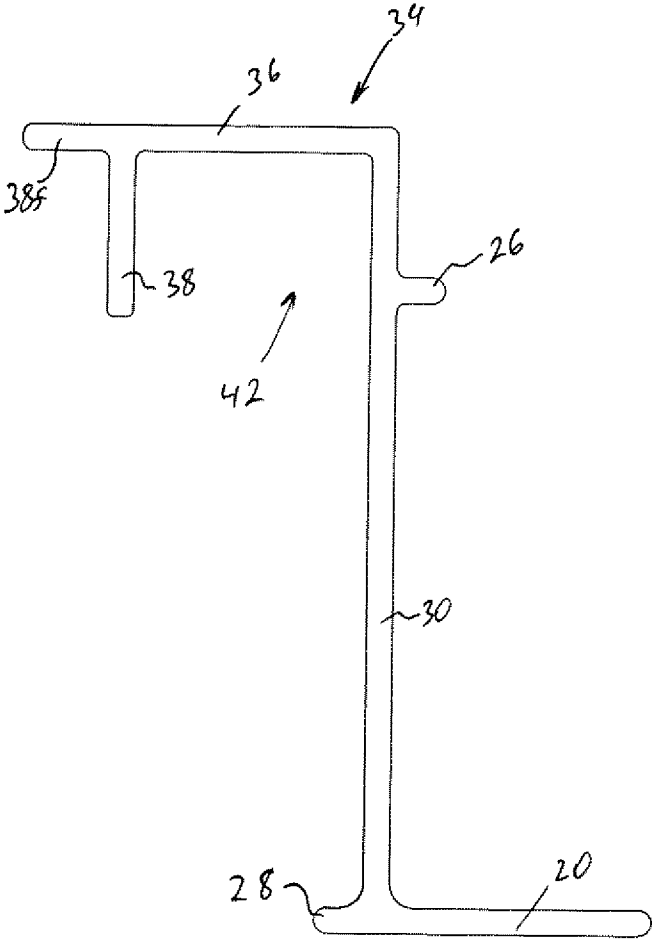

The J-wall 34 enforces the first moisture gap between an insulation panel and exterior decorative panel. It should be appreciated however, that the J-wall wall 34 need assume the shape of a "J" but may be executed in a plurality of other shapes. FIGS. 3A-3H demonstrate some of the alternative designs for the J-wall 34. The first portion 36 may be at a right angle with the second portion 38, with the second portion 38 not bending laterally towards the first side 33 but remaining substantially straight until the free end 39, as shown in FIG. 3A, or the free end may bend laterally for form a wall 38*b* that is coplanar with the lip 24 (FIG. 3*d*). Alternatively, the first portion 36 may meet the second portion 38 at an acute angle 38*c* (FIG. 3B) or an obtuse angle (FIG. 3*e*). The J-shaped wall 34 may assume a substantially trapezoidal shape (FIG. 3C), with the first wall 35 bending slightly laterally, and meeting the first portion 36 at an obtuse angle, with the first portion 36 connecting to the second portion at an obtuse angle and to wall 38*b* at an acute angle, with the wall 38*b* being co-planar with the upper lip 26. The second portion 38 may be extend rearwardly from the free end of the first portion 36 but set off at a distance from the free end, creating an overhanging extension 38*f* (FIG. 3F).

Figure 3G:
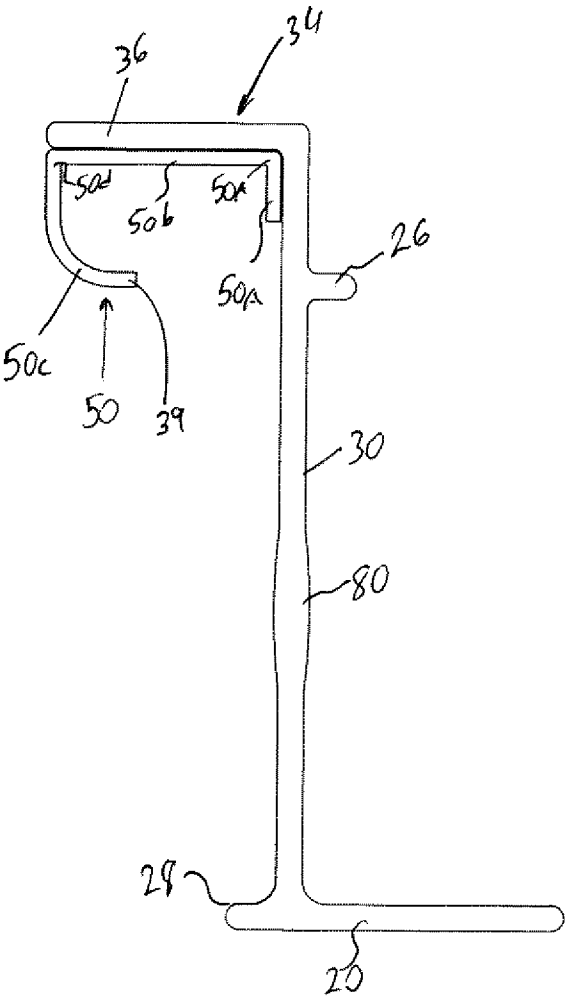
Figure 3H:
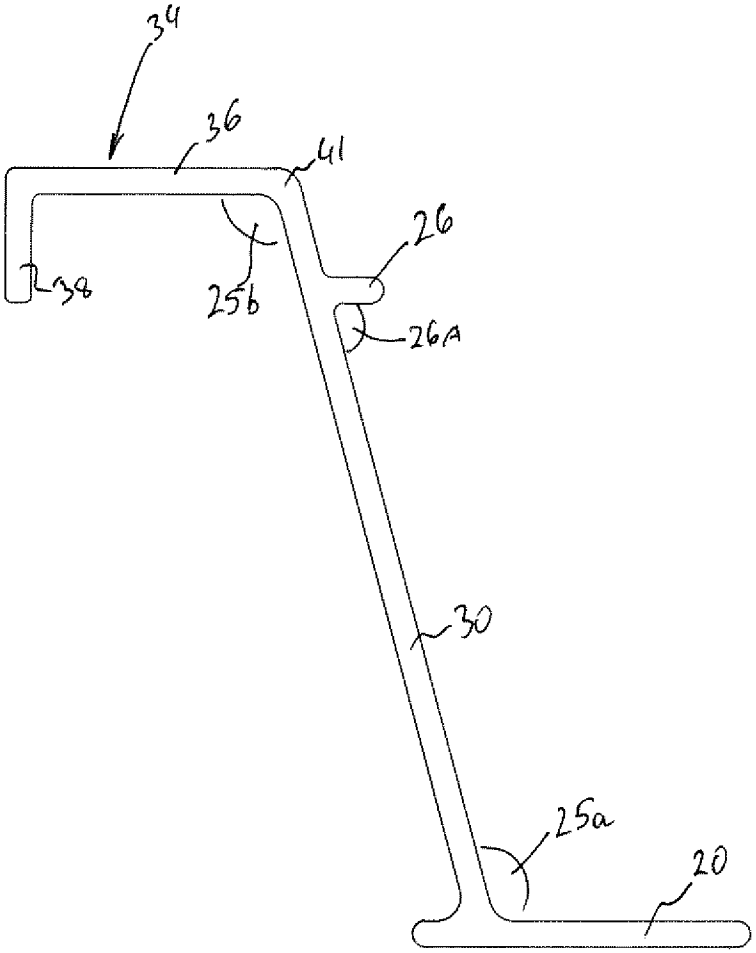
Figure 11:
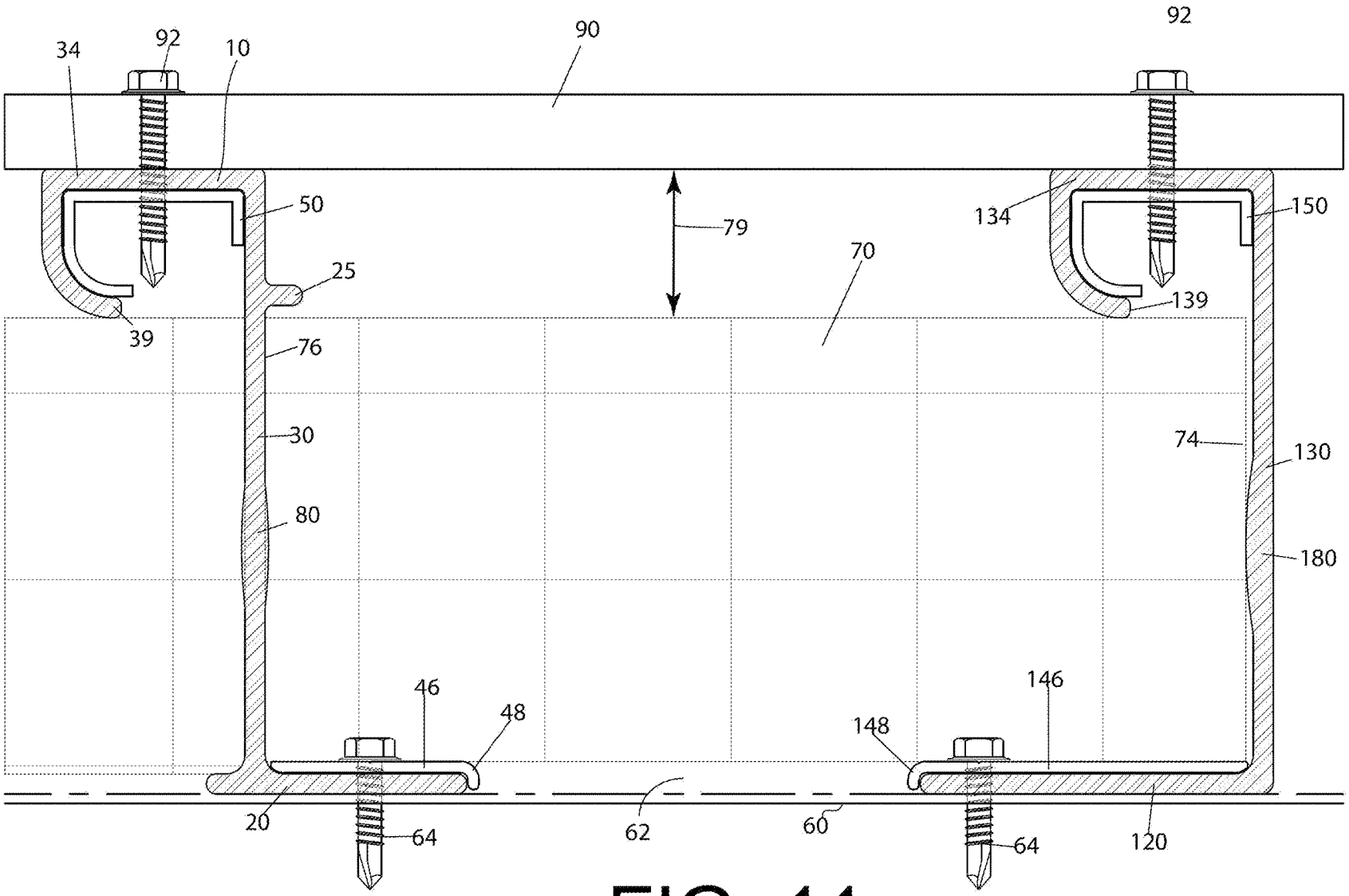
FIG. 11 showing the sideways views of the Z-shaped component and Edge component.

As shown in FIG. 3G, the second portion 38 may be replaced by the removable insert 50. The third wall 50*c* of the insert 50 fulfilling the function of the second portion 38. The free end 39, of the insert 50 now enforcing the thickness of the first moisture gap 79 (FIG. 11). The second wall 30 may be at an angle 25*a* to the first wall 20, that is more of an obtuse angle. The same obtuse angle 25*b* would then preferably be present at free end 41 of the second wall 30 if it is desirable that the first portion 36 remain parallel to the plane of the first wall 20. The upper lip 26 would preferably remain parallel to the plane of the first wall 20, creating an acute angle 26*a*.

Figure 4:
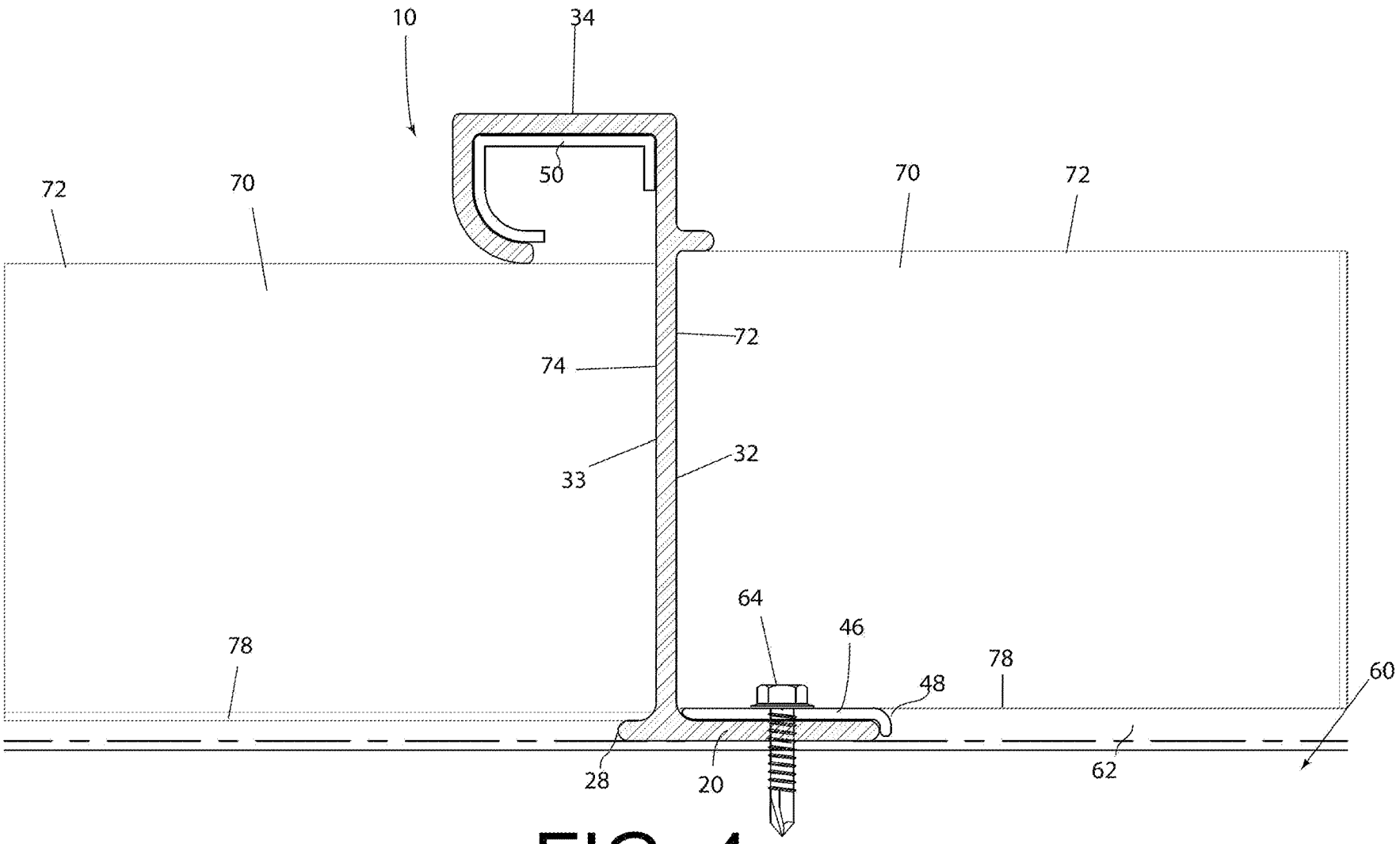
FIG. 4 is another sideview of the Z-shaped component showing insulation panels installed adjacently to first and second sides of the second wall.

FIG. 4 demonstrates the Z-shaped component 10 mounted onto an existing wall 60 with a fastener 64. The fastener 64 is shown perforating the protective bracket 46 and the first wall 20. In this respect the protective bracket 46 functions as a washer and anchor point to ensure that the first wall 20 does not fracture under the strain of the fastener 64. The insert 50 and the protective bracket 46 permit the Z-shaped component to be manufactured out of polymers or other composite materials to minimize cost of manufacturing or weight of the overall construction, with insert 50 and the protective bracket 46 adding strength to the arrangement.

The first end 74 of each insulation panel 70 is adjacent to the second side 33 of the second wall 30 and the first end 76 is adjacent to the second side 32. Each insulation panel 70 is secured in place along its top surface 72 by the lip 25 of one Z-shaped component 10 and the free end 39 of the next Z-shaped component 10. The space 79 then represents the first moisture gap.

The bottom surface 78 of each insulation panel 70 rests on the lip 24 of the first wall of one Z-shaped component 10 and the first wall 20 of an adjacent Z-shaped component 10. The thickness of the first wall 20 creates the second moisture gap 62 between an existing wall 60 and each insulation panel 70.

Figure 5:
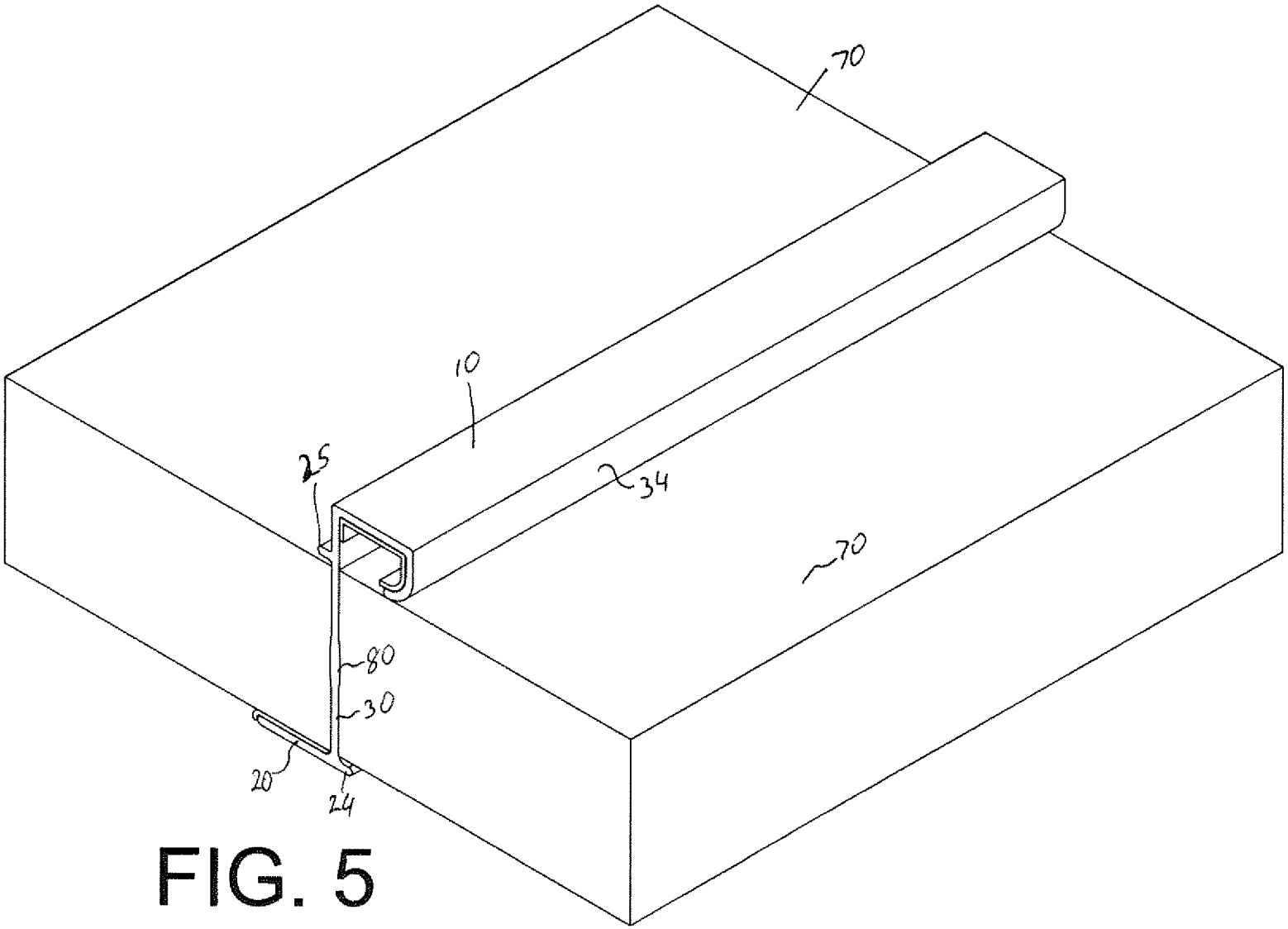
FIG. 5 is a perspective view of the Z-shaped component shown in FIG. 4, which also shows the concave section along the height of the second wall.
Figure 6:
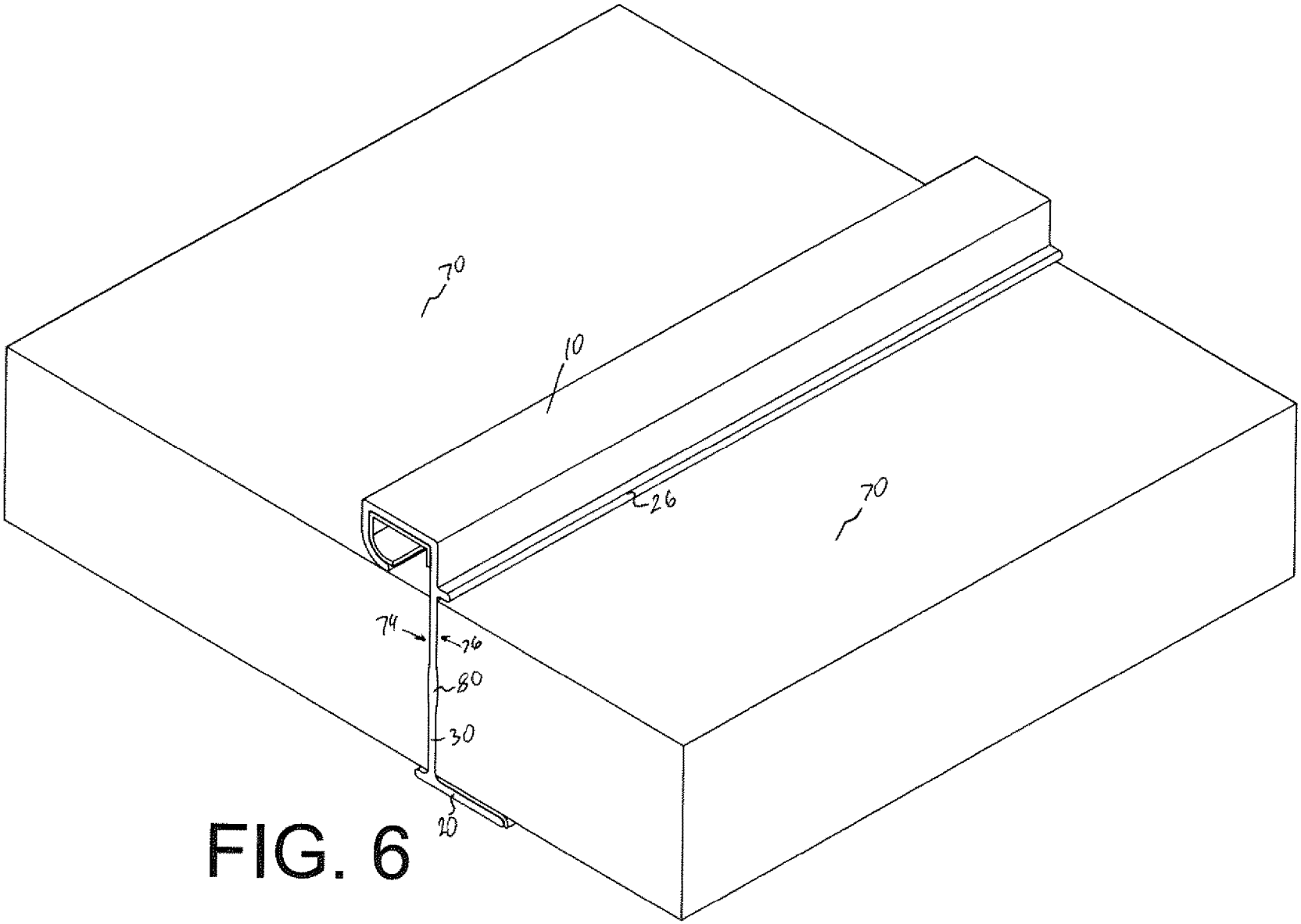
FIG. 6 is the perspective view showing the second side of the Z-shaped component shown in FIG. 5.

FIG. 5 demonstrates the general deployment of Z-shaped component 10 that is shown between two insulation panels 70. The insulation panels 70 are shown contained between the upper lip 26 and J-wall 34 and the lower lip 28 and first wall 20. FIGS. 5 and 6 demonstrate and embodiment featuring a concave section 80 along the height of the second wall 30. The concave section 80 may contain a flared section on at least one side of the second wall 30 and is intended to immobilize and seal the point of contact between the second wall 30 and the first and second ends 76 and 74 of the insulating panels 70.

Figure 7:
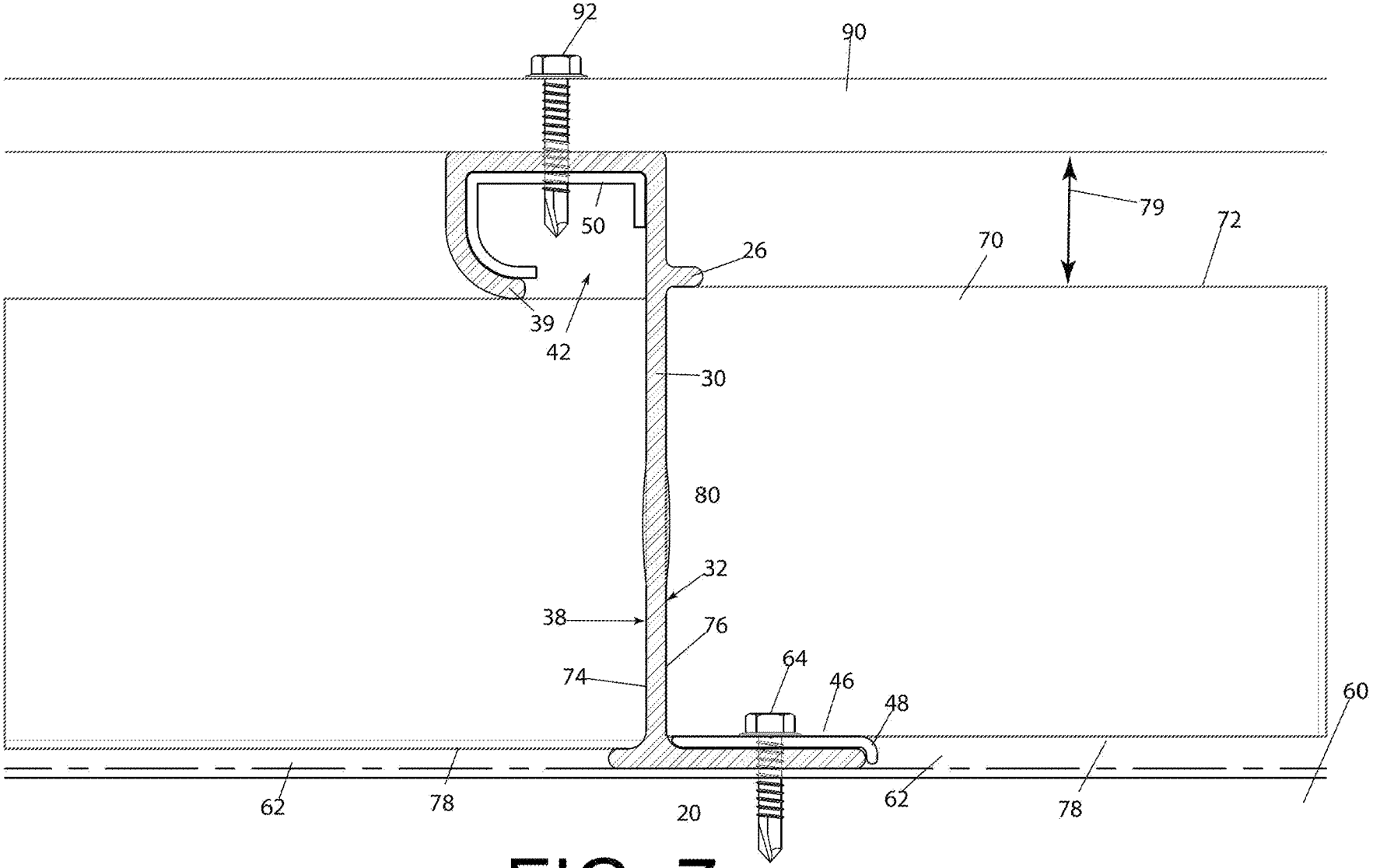
FIG. 7 is a sideways view of the Z-shaped component showing concave section and an external panel bolted to the outer surface of the first portion of the J-shaped wall.

FIG. 7 demonstrates the full deployment of one of a plurality of Z-shaped components 10. The first wall 20 is shown attached to the existing wall 60 with a fastener 64. Extending forwardly at an angle, preferably a right angle, from the first wall 20 is the second wall 30. The second wall 30 is in joined communication with first and second ends 76 and 74 of the insulating panels 70, which are further immobilized by the flared section 80. An upper lip 26 captures the top surface 72 of one of the insulation panels. The set off 25 of the upper lip 26 from the free end 41 of the second wall enforces along the first side 32 the required first moisture gap 79, otherwise known as thermal gap. The wall panel 90 representing an external or cladding paneling 90 is fastened to the outer surface 40 of the J-wall 34. The free end 39 of the J-wall 34 enforces the air or moisture gap 79 along the second side 33 of the Z-shaped component 10. The insert 50, if deployed within the hollow channel 42 and is also used as the anchor point for the fastener 92. The preferred thickness of the moisture gap 79 may be preferably between 1.5 and 2.5 centimeters.

Figure 8:
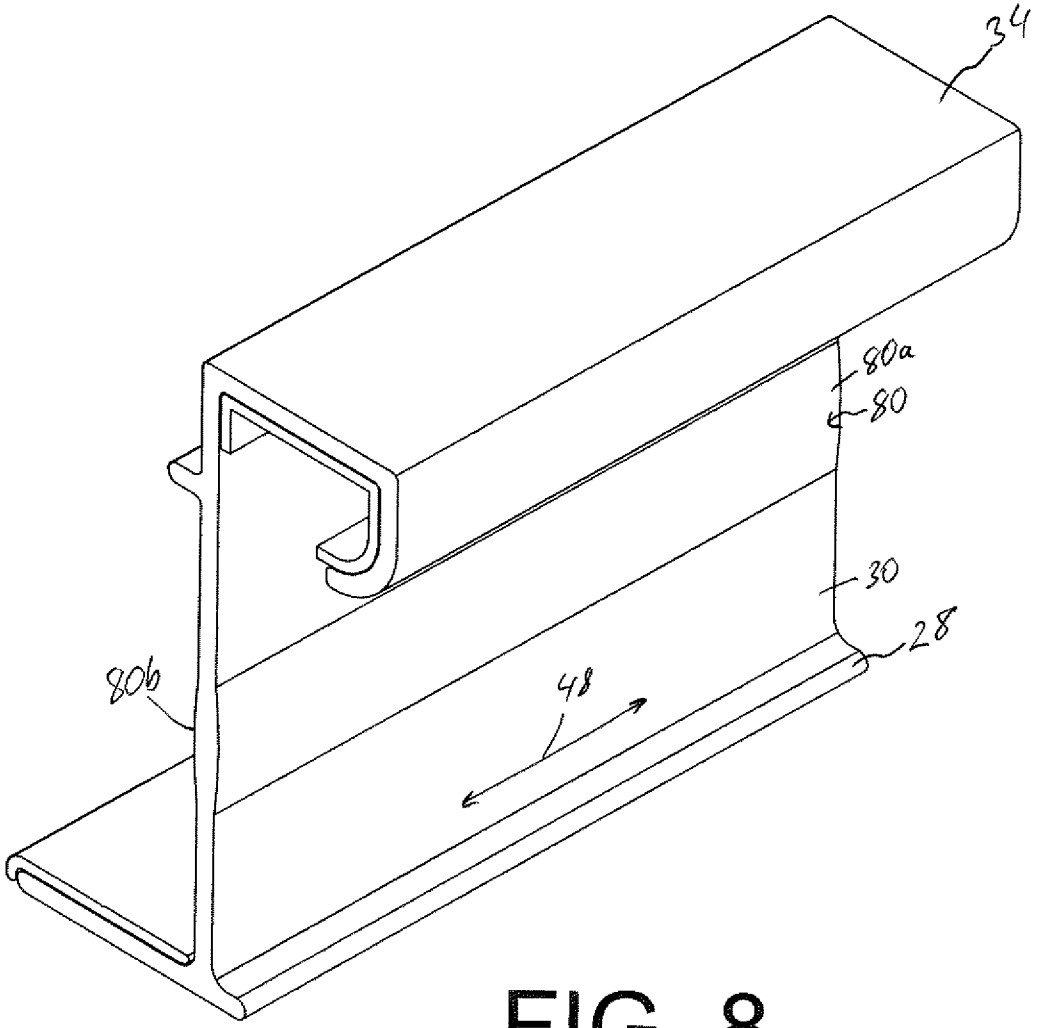
FIGS. 8 and 9 demonstrated the concave section along the height of the second wall.
Figure 9:
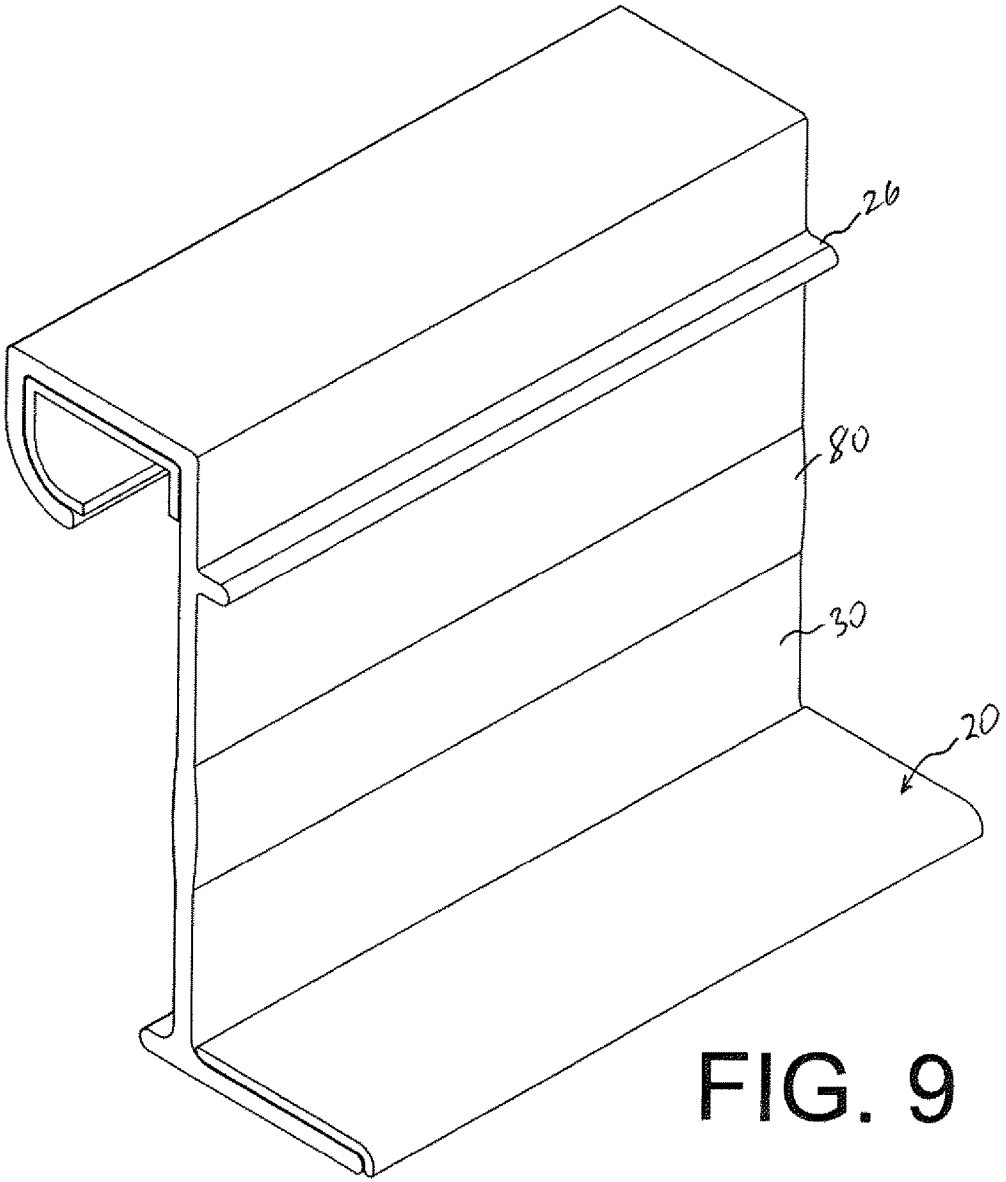

FIGS. 8 and 9 further demonstrate the flared section 80 shown here to be disposed along the entire length of the second wall 30 and on both sides thereof. Alternatively, the flared section 80 may be placed in one or several locations along the length 48 or on only one of the two sides of the second wall 30. There may be a flared section 80*a* and 80*b* on either side of the second wall 80 or just on one of the sides.

Figure 10:
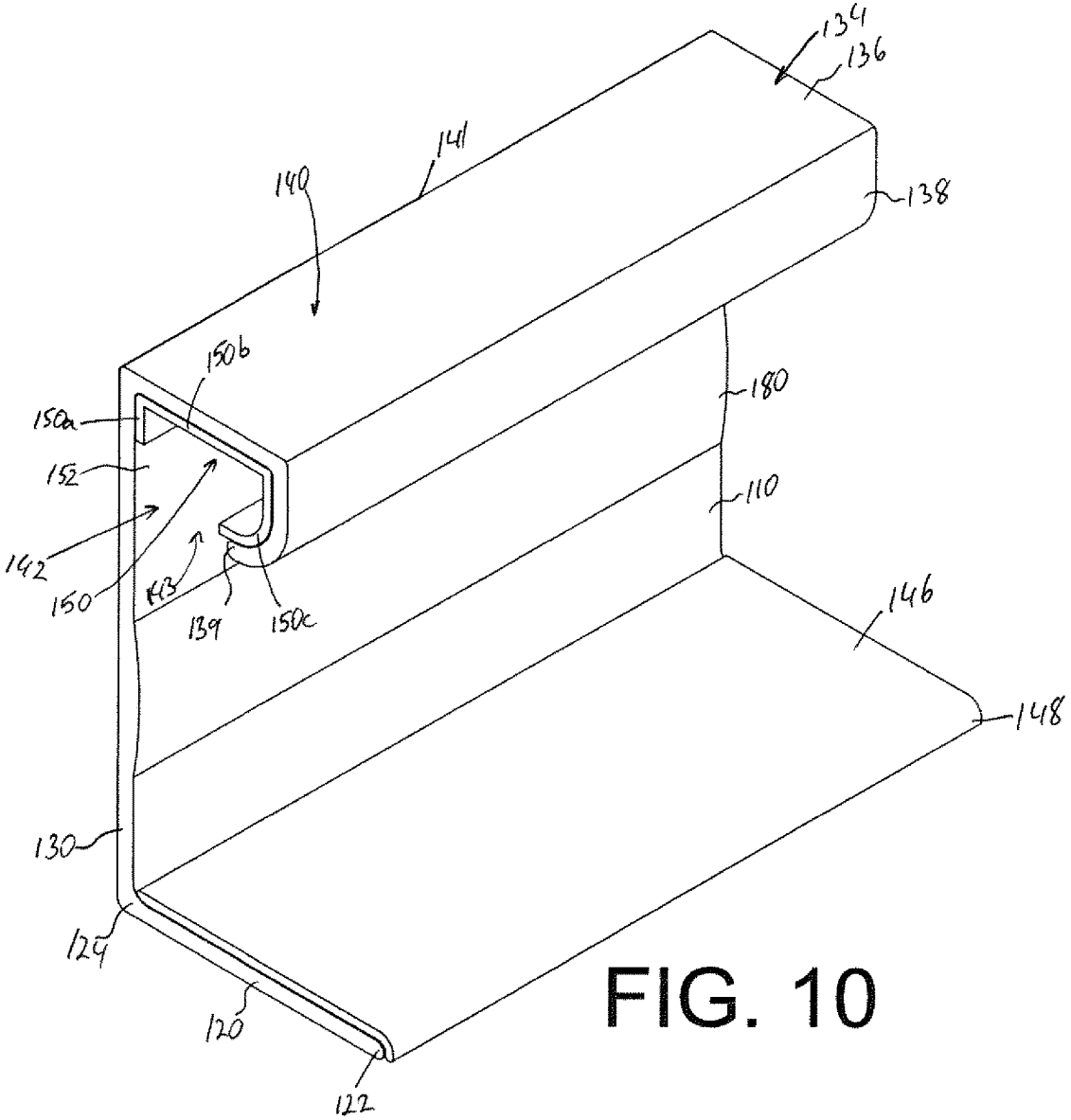
FIGS. 10 and 10A are perspective views of the edge component, with FIG. 10 having the flared section along the second wall.

FIG. 10 demonstrates an edge component 110. Shown is the first wall 120, having a first end 122 and a second end 124. The first wall 120 being parallel with an existing wall 60 (FIG. 11) and being fastened thereon. Extending forwardly at an angle, preferably a right angle, from the free end, otherwise known as the second end 124, is the second wall 130. Extending from the free end 141 of the second wall 130 is the J-wall 134. The first portion of the J-wall 136 extends in the same direction, and in a parallel orientation as the first wall 120. The second portion 138 extends downward from the free end of the first portion 136, with the free end 139 bending toward the second wall 130 and stopping at a distance therefrom, thus creating a gap 143. The curvature of the J-wall 134 forming a hollow channel 142.

The insert 150 is preferably present and is removably inserted into the hollow channel 142 either through the side opening 132 or through the gap 143. The insert 150 having the first wall 150*a*, shown substantially as a stub wall adjacent to the second wall 130. Extending laterally at an angle, preferably a right angle, from the first wall 150*a*, is the second wall 150*b* that is adjacent with and parallel to the first portion 136. Extending downwardly from the free end of the second wall 150*b* is the third wall 150*c*, which in this embodiment is adopted to mirror the curvature of the second portion 138. It should be appreciated that the walls 150*a*-150*c* may be shaped differently and not be completely or actually adjacent to the outer walls forming the hollow channel 142. It should alto be appreciated that the insert 150 may be a solid rod or cuboid or extending part of the way within the length of the hollow channel 142. It should further be appreciated that FIGS. 3A-3E depicting various shapes of the J-wall 134 of the Z-shaped component 10 may be implemented with the Edge component 100 with equal effectiveness. The embodiment shown in FIG. 10 demonstrates the protective bracket 146, further having the flange 148.

Figure 10A:
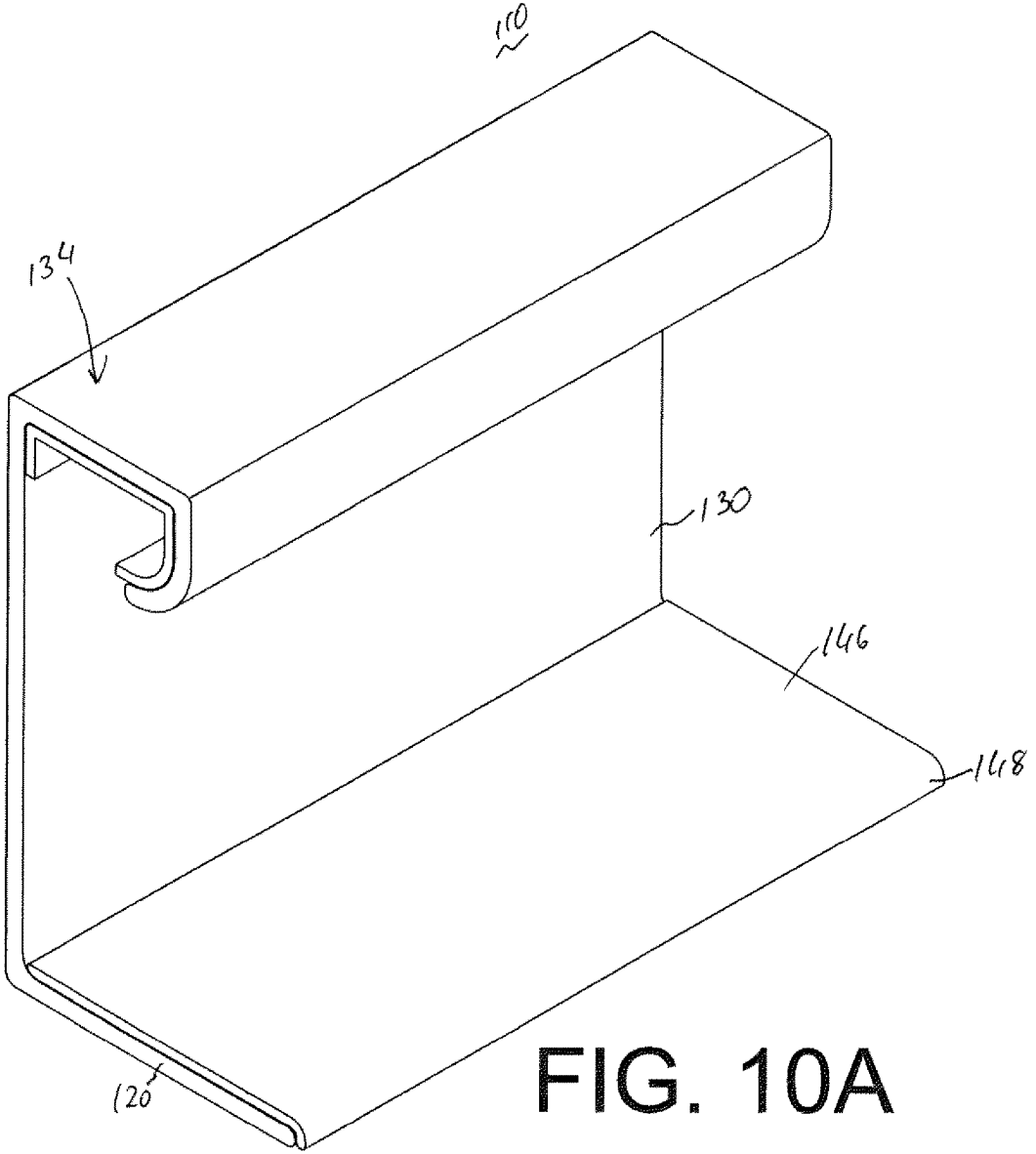

FIG. 11 demonstrates the implementation of the edge component 110 along with the Z-component 10. The edge component 100 is deployed along an existing wall 60 in a parallel, spaced apart configuration with one of a plurality of the Z-shaped components 10. An insulation board is retained between the the edge component 100 and the adjacent Z-shaped component 10. Where the first end 76 is adjacent to the second wall 30 and the second end 74 is adjacent to the second wall 130. The embodiment shown further comprises flared section 80 on the second wall 30 and the flared section 180 on the second wall 130. However, as shown in FIG. 10A, the second wall 130 need not include the flared section 180. Either or both the Z-shaped component 10 or the edge component 100 may be deployed with the second wall thereof not featuring a flared section.

It is preferred that the free end 39 of the Z-shaped component 10, the free end 139 of the Z-shaped component 100 and the upper lip of the Z-shaped component 10 are coplanar, to enforce a uniform, or minimum, moisture or thermal gap 79 between the top surface of the insulation panel and the exterior or cladding paneling 90. The exterior panel 90 is fastened to the J-wall 34 and the J-wall 134. The second moisture gap 42 is enforced by the first wall 20 and the first wall 120 of the Z-shaped component 10 and the edge component 100, respectively.

Figure 12:
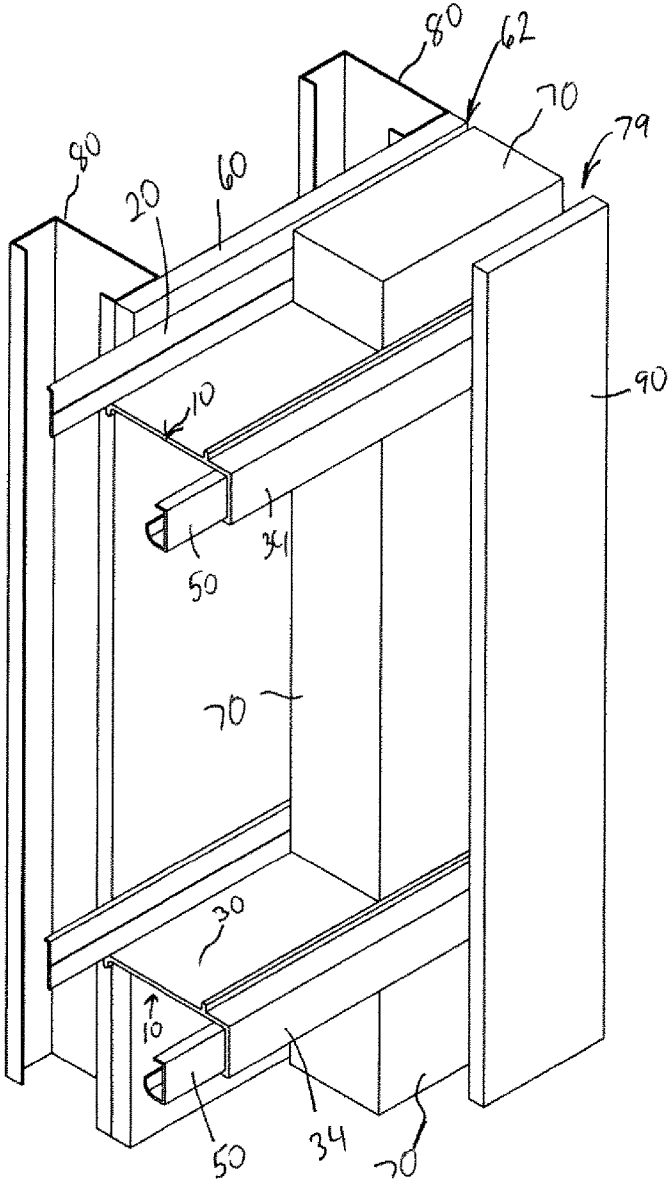
FIG. 12 is a view of a plurality of Z-shaped components with insulation panels installed therebetween.

FIG. 12 demonstrates the plurality Z-shaped components 10, deployed in a parallel and spaced apart configuration along an existing wall 60. The plurality of insulation panels 70, with each panel retained within the space between two adjacent Z-shaped components 10, or adjacent Z-shaped component and an Edge component. A plurality of exterior wall panels 90 fastened to the J-walls 34 of the Z-shaped components 10 or/and the edge components. The J-wall 34 is shown creating the first moisture gap 79, and the first wall 20 is shown creating the second moisture gap 62.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A system of securing insulation between an existing wall and exterior wall panels comprising:

a plurality of Z-shaped components;

each of said plurality of said z-shaped components having a first wall, said first wall having a first end and a second end, said first wall being parallel to and mounting on an existing wall;

a second wall extending outwardly at an angle from said second end, said second wall having first side and a second side;

a J-shaped wall, said J-shaped wall extending in an opposite direction from said first wall, said J-shaped wall extending from a free end of said second wall;

wherein said J-shaped wall further comprising a first portion, said first portion being in a parallel orientation with said first wall, a first portion configured to have a wall panel fastened thereto;

a second portion extending rearwardly from said first portion in a spaced apart relation to said second wall;

wherein said first side further comprises an upper lip, said upper lip being co-planar to said free end of said second portion;

said Z-shaped component configured to retain at least one of a plurality of insulation panels, each one of said plurality of insulation panels configured to be mounted between two of said plurality of Z-shaped components; wherein a bottom surface of each of said plurality of insulation panels is configured to be adjacent to said first wall and a top surface of each of said plurality of insulation panels is configured to be adjacent to the free end of said J-shaped wall; and wherein a first end of each of said insulation panels configured to be adjacent to said second side of a first of said two of said plurality of Z-shaped components and wherein the second end of each of said insulation panels configured to be adjacent to said first side of a second said two of said plurality of Z-shaped components.

2. The system of securing insulation between an existing wall and exterior wall panels of claim 1, wherein said second wall is set off inwardly from said second end, wherein the length of said first wall between said second end and said second wall forming a lower lip that is co-planar with said first wall.

3. The system of securing insulation between an existing wall and exterior wall panels of claim 1, wherein said second wall is set off inwardly from said second end, wherein the length of said first wall between said second end and said second wall forming a lower lip that is co-planar with said first wall.

4. The system of securing insulation between an existing wall and exterior wall panels of claim 1, wherein said first side or said second side further comprises a flared section along a portion of a height of said second wall.

5. The system of securing insulation between an existing wall and exterior wall panels of claim 3, wherein said first side or said second side further comprises a flared section along a portion of a height of said second wall.

6. The system of securing insulation between an existing wall and exterior wall panels of claim 1, further comprising an edge component, said edge component being in a spaced apart parallel relation to at least one of said plurality of said Z-shaped components; wherein said edge component having a first wall, said first wall being parallel with an existing wall and configured to be fastened thereto; a second wall extending at an angle from a free end of said first wall of the edge component, said second wall of the edge component having first side and a second side; a J-shaped wall extending from a free end of said second wall of the edge component, said J-shaped wall of the edge component further comprising a first portion extending from a free end of said second wall of said edge component; wherein said first portion of the edge component being in a spaced apart and parallel relation to the first wall of the edge component;

a second portion of said J-shaped wall of the edge component extending rearwardly from said first portion in a spaced apart relation to said second wall of the edge component; wherein an outer surface of said first portion of the edge component configured to have a wall panel fastened thereto; wherein a free end of said second portion of the edge component being co-planar with the free end of the J-shaped wall of one of the plurality of Z-shaped components that is adjacent to said edge component; and wherein one of said plurality of said insulation panels configured to fit in a space between said edge component and one of said Z-shaped components that is adjacent to said edge component.

7. The system of securing insulation between an existing wall and exterior wall panels of claim 6, wherein the first side of said edge component having a concave section along a height of said second wall.

8. The system of securing insulation between an existing wall and exterior wall panels of claim 1, further comprising an insert, said insert configured to fit within a cavity formed by a combination of walls and angles comprised of said second wall and said J-shaped wall; wherein walls and angles of said insert fitting adjacently within the walls and angles of said cavity.

9. The system of securing insulation between an existing wall and exterior wall panels of claim 5, further comprising an insert, said insert configured to fit within a cavity formed by a combination of walls and angles comprised of said second wall and said J-shaped wall; wherein walls and angles of said insert fitting adjacently within walls and angles of said cavity.

10. The system of securing insulation between an existing wall and exterior wall panels of claim 7, further comprising an insert, said insert configured to fit within a cavity formed by a combination of walls and angles comprising said second wall and said J-shaped wall of any one of said Z-shaped components or within a cavity formed by a combination of said second wall and said J-shaped wall of said edge component; wherein walls and angles of said insert fitting adjacently within the walls and angles of each of said cavities.

11. The system of securing insulation between an existing wall and exterior wall panels of claim 5, wherein said first wall further comprising a protective bracket; wherein said protective bracket covering said first wall; and said protective bracket configured to accept a fastener, said fastener perforating said protective bracket and said first wall.

12. The system of securing insulation between an existing wall and exterior wall panels of claim 10, wherein said first wall of any of said plurality of the Z-shaped components or the first all of said edge component further comprising a protective bracket; wherein said protective bracket covering said first wall of one of said plurality of the Z-shaped components or the first wall of said edge component; and wherein said protective bracket configured to accept a fastener therethrough, said fastener perforating protective wall and said first wall of said plurality of the Z-shaped components or the first wall of said edge component.

13. The system of securing insulation between an existing wall and exterior wall panels of claim 11, wherein said protective bracket further comprising a flange extending rearwardly, said flange draping over an edge of said first end.

14. The system of securing insulation between an existing wall and exterior wall panels of claim 12, wherein said protective bracket further comprising a flange extending rearwardly, said flange draping over an edge of said first end of the first wall of any of said plurality of the Z-shaped components or the edge component.

15. The system of securing insulation between an existing wall and exterior wall panels of claim 12, wherein the first wall is configured to create a second moisture barrier between the bottom surface of one of the plurality of insulation panels and the surface of an existing wall.

16. The system of securing insulation between an existing wall and exterior wall panels of claim 1, wherein the first wall is configured to create a second moisture barrier between the bottom surface of one of the plurality of insulation panels and the surface of an existing wall.

17. The system of securing insulation between an existing wall and exterior wall panels of claim 1, wherein said third wall is configured to enforce a first moisture barrier between one of said plurality of insulation panels and exterior wall panels.

18. The system of securing insulation between an existing wall and exterior wall panels of claim 12, wherein the first, wall is configured to create a second moisture barrier between the bottom surface of one of the plurality of insulation panels and the surface of an existing wall; and wherein said third wall is configured to enforce a first moisture barrier between one of said plurality of insulation panels and exterior wall panels.

* * * * *